US011377888B2

(12) United States Patent
Shih

(10) Patent No.: US 11,377,888 B2
(45) Date of Patent: Jul. 5, 2022

(54) MAGNETIC LOCK WITH RESILIENT ABUTTING MEMBER FOR ELIMINATING REMANENCE

(71) Applicant: Soyal Technology Co., Ltd., New Taipei (TW)

(72) Inventor: Hung-Kun Shih, New Taipei (TW)

(73) Assignee: SOYAL TECHNOLOGY CO., LTD., New Taipei (TW)

( * ) Notice: Subject to any disclaimer, the term of this patent is extended or adjusted under 35 U.S.C. 154(b) by 269 days.

(21) Appl. No.: 16/828,944

(22) Filed: Mar. 24, 2020

(65) Prior Publication Data

US 2021/0222469 A1 Jul. 22, 2021

(30) Foreign Application Priority Data

Jan. 17, 2020 (TW) ..... 109101655

(51) Int. Cl.
*E05C 19/16* (2006.01)
*E05B 47/00* (2006.01)

(52) U.S. Cl.
CPC ..... *E05C 19/166* (2013.01); *E05B 47/0002* (2013.01)

(58) Field of Classification Search
CPC ..... Y10T 292/11; Y10T 292/0969; Y10T 292/68; Y10T 16/5401; Y10T 24/32;
(Continued)

(56) References Cited

U.S. PATENT DOCUMENTS 5,033,779 A 7/1991 Geringer et al.
5,611,582 A * 3/1997 Frolov ..... E05C 19/166 292/251.5

(Continued)

FOREIGN PATENT DOCUMENTS

CN 203729699 U 7/2014
CN 104895413 A 9/2015

(Continued)

OTHER PUBLICATIONS

European Patent Office, "European Search Report and Search Opinion on European Patent Application No. EP20168849.6", dated Sep. 18, 2020, 7 pages, Munich, Germany.

*Primary Examiner* — Mark A Williams

(57) ABSTRACT

A remanence-eliminating magnetic lock includes a housing, an electromagnetic body and a resilient abutting member. The electromagnetic body can be assembled into the housing and receive externally-supplied electricity to generate a magnetic attraction force on a top surface thereof. The resilient abutting member has a fixing end to be fixed within the housing or the electromagnetic body, and an abutting end exposed from the housing or the top surface of the electromagnetic body. A peak of the abutting end is higher than the top surface of the electromagnetic body. When a metal member is magnetically attached to the top surface of the electromagnetic body, the metal member pressures the abutting end to deform. When the supply of electricity to the magnetic lock is cut off, the abutting end pushes the metal member through a restoring force thereof to move the metal member away from the electromagnetic body to eliminate remanence.

5 Claims, 9 Drawing Sheets

(58) Field of Classification Search
CPC ... Y10T 403/60; E05C 19/166; E05C 19/168; E05C 17/56; E05C 19/16; E05B 47/0002; E05B 47/0006; E05B 15/022
See application file for complete search history.

(56) References Cited

U.S. PATENT DOCUMENTS

| | | | | |
|---|---|---|---|---|
| 6,053,546 | A | 4/2000 | Frolov | |
| 8,534,637 | B2 * | 9/2013 | Kuo | H05K 7/142 248/500 |
| 8,757,685 | B2 * | 6/2014 | Chang | E05C 19/166 292/251.5 |
| 9,062,481 | B2 * | 6/2015 | Liao | E05C 19/166 |
| 9,341,007 | B2 * | 5/2016 | Liao | E05C 19/166 |
| 10,526,815 | B2 * | 1/2020 | Gillespie | E05B 47/0047 |
| 2008/0209813 | A1 * | 9/2008 | Haab | E05D 15/0621 49/360 |
| 2010/0038920 | A1 * | 2/2010 | Tsai | E05B 47/0047 292/341.16 |
| 2010/0218569 | A1 * | 9/2010 | Hunt | E05B 65/108 70/276 |
| 2010/0230979 | A1 * | 9/2010 | Gries | E05C 19/16 292/251.5 |
| 2015/0211270 | A1 * | 7/2015 | Benhammou | H01H 47/22 361/156 |
| 2015/0211271 | A1 * | 7/2015 | Benhammou | E05B 17/10 292/251.5 |
| 2015/0308170 | A1 * | 10/2015 | Chang | E05C 19/166 292/251.5 |

FOREIGN PATENT DOCUMENTS

| | | | |
|---|---|---|---|
| FR | 2796751 | A1 | 1/2001 |
| TW | M584827 | U | 10/2019 |

* cited by examiner

MAGNETIC LOCK WITH RESILIENT ABUTTING MEMBER FOR ELIMINATING REMANENCE

CROSS-REFERENCE TO RELATED PATENT APPLICATION

This non-provisional application claims priority to and the benefit of, under 35 U.S.C. § 119(a), Taiwan Patent Application No. 109101655, filed in Taiwan on Jan. 17, 2020. The entire content of the above identified application is incorporated herein by reference.

FIELD

The present disclosure relates to a magnetic lock, and more particularly to a magnetic lock that has a resilient abutting member disposed therein so as to eliminate remanence.

BACKGROUND

Locks are generally installed on doors, windows, cabinets, etc. for the purpose of protecting one's properties from invasion by others. However, since locks with a simple mechanical structure are more easily bypassed (such as with a master key), in order to increase security, people have begun to adopt the use of electromagnetic locks such as magnetic locks, magnetic card locks, password locks, and wireless remote-controlled locks.

In continuance of the above, the basic implementation of a magnetic lock (i.e., an electromagnetic lock) using the electromagnetic induction principle is described in the following. Referring to FIG. 1, a magnetic lock 11 is usually installed on a door frame, and includes a silicon steel sheet 111 disposed therein. When the magnetic lock 11 is supplied with electricity, a top end of the silicon steel sheet 111 generates magnetic attraction, and an armature plate 12 disposed on the door panel is magnetically attracted and therefore attached to the magnetic lock, such that the door panel is in a locked state and cannot be opened. On the other hand, when the supply of electricity to the magnetic lock 11 is cut off, the magnetic attraction from the silicon steel sheet 111 ceases, and the magnetic lock 11 is unable to attract and be attached to the armature plate 12, such that the door panel is in an unlocked state and can be opened. Therefore, since the magnetic lock does not have a complicated mechanical structure or a lock tongue mechanism, and depends solely upon the electrical state thereof for locking and unlocking, the magnetic lock is often used on emergency exit doors or fire doors for access control.

In practical application however, due to magnetization, the magnetic lock 11 and the armature plate 12 can still maintain a degree of magnetic strength therebetween even after the supply of electricity to the magnetic lock is cut off, such that the armature plate 12 cannot detach from the magnetic lock 11, and the door panel remains in the locked state. This is an effect of a phenomenon referred to as "remanence." However, since magnetic locks are usually used on emergency exits and fire doors, apparent negative consequences may be foreseen if a user is prevented from pushing open a magnetically locked door as a result of remanence. Therefore, the conventional magnetic lock 11 is commonly designed with a mechanism for eliminating remanence.

Referring to FIGS. 1 and 2, the armature plate 12 includes an abutting column 121, a spring 122, a through hole 120 formed therein, and a shoulder portion 123 protruding from an inner sidewall thereof that divides the through hole 120 into upper and lower regions (according to the directional orientation of FIG. 2). In addition, the abutting column 121 at least includes an impact portion 1211 and a rod 1213. The impact portion 1211 has a diameter larger than that of a hole surroundingly defined by the shoulder portion 123, and the rod 1213 has a diameter smaller than that of the hole surroundingly defined by the shoulder portion 123, so that the abutting column 121 is in the shape of an inverted letter T (according to the directional orientation of FIG. 2). The impact portion 1211 is located in the lower region of the through hole 120, and is blocked by the shoulder portion 123, while a top end of the rod 1213 passes through the hole defined by the shoulder portion 123 to be located in the upper region of the through hole 120. An outer edge of the top end of the rod 1213 can have a fixing member 124 disposed thereon (e.g., a C-shaped fastener) so that the top end of the rod 1213 cannot pass back through the hole defined by the shoulder portion 123 and is limited in both position and movement to be within the through hole 120, unable to completely escape from the through hole 120.

Further referring to FIGS. 1 and 2, the spring 122 is located in the lower region of the through hole 120, and is located between the impact portion 1211 and the shoulder portion 123, so that when the magnetic lock 11 is in the locked state, the silicon steel sheet 111 will magnetically attract and be attached to the armature plate 12, and at the same time cause the entire abutting column 121 to retract into the through hole 120, so that the spring 122 is pressed against by the impact portion 1211 to store a restoring force. When the magnetic lock 11 is in the unlocked state, the silicon steel sheet 111 no longer attracts the armature plate 12, and the spring 122 propels the impact portion 1211 through the restoring force so that the abutting column 121 rushes outward to impact the silicon steel sheet (as indicated by the bold arrow in FIG. 3), and the silicon steel sheet 111 and the armature plate 12 move away from each other to form a gap G (as shown in FIG. 3), thereby resolving the remanence issue and allowing the door panel to be opened.

However, certain problems still exist in the above-mentioned remanence-eliminating mechanism. Firstly, since the abutting column 121 is in direct contact with the silicon steel sheet 111, an electroplated layer on the surface of the silicon steel sheet 111 is prone to damage after long-term use, which causes the silicon steel sheet 111 to rust and in turn affects the magnetic attraction force thereof. Furthermore, since the armature plate 12 is widely made of pure ferrite and has a relatively low hardness (i.e., is softer), when the through hole 120 is formed therein, a structural integrity of the armature plate 12 will be compromised, which can easily cause deformation. This not only reduces the lifetime of the product, but also affects the magnetic attraction of the silicon steel sheet 111 toward the armature plate 12. Therefore, it is an important issue to provide the user with an improved magnetic lock that is capable of overcoming the aforementioned inadequacies.

SUMMARY

In response to the above-referenced technical inadequacies associated with conventional remanence-eliminating magnetic locks, the present disclosure has culminated in the conception and development of a magnetic lock having a resilient abutting member for eliminating remanence. The present disclosure manifests years of practical experience in designing, processing, which, combined with long hours of research and experimentation, leads to such conception and development. The present disclosure is with the aim of overcoming the above-referenced technical inadequacies and appealing to consumers through redesigning of the remanence-eliminating mechanism.

In one aspect, the present disclosure is directed to a remanence-eliminating magnetic lock including a housing that has a receiving space formed therein, an electromagnetic body, and a resilient abutting member. The electromagnetic body is to be assembled within the receiving space of the housing with a top surface of the electromagnetic body being exposed from the housing, receive externally supplied electricity, and generate a magnetic attraction force on the top surface of the electromagnetic body. The resilient abutting member has a fixing end to be fixed within the housing or the electromagnetic body, and an abutting end to be exposed from the housing or the top surface of the electromagnetic body with a peak of the abutting end being at a higher elevation than the top surface of the electromagnetic body. When the magnetic lock is supplied with electricity and a metal member is magnetically attracted and attached to the top surface of the electromagnetic body, the abutting end deforms by being pressured by the metal member and generates a restoring force. When the supply of electricity to the magnetic lock is cut off, the abutting end pushes the metal member, through the restoring force, to move metal member away from the top surface of the electromagnetic body to eliminate remanence.

Therefore, since the resilient abutting member will not directly impact the electromagnetic body and is disposed within the magnetic lock, the magnetic lock of the present disclosure can have a longer service life and will not cause the electromagnetic body to sustain damage in a remanence-eliminating process, which compares favorably to the conventional magnetic locks.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION

Figure 1:
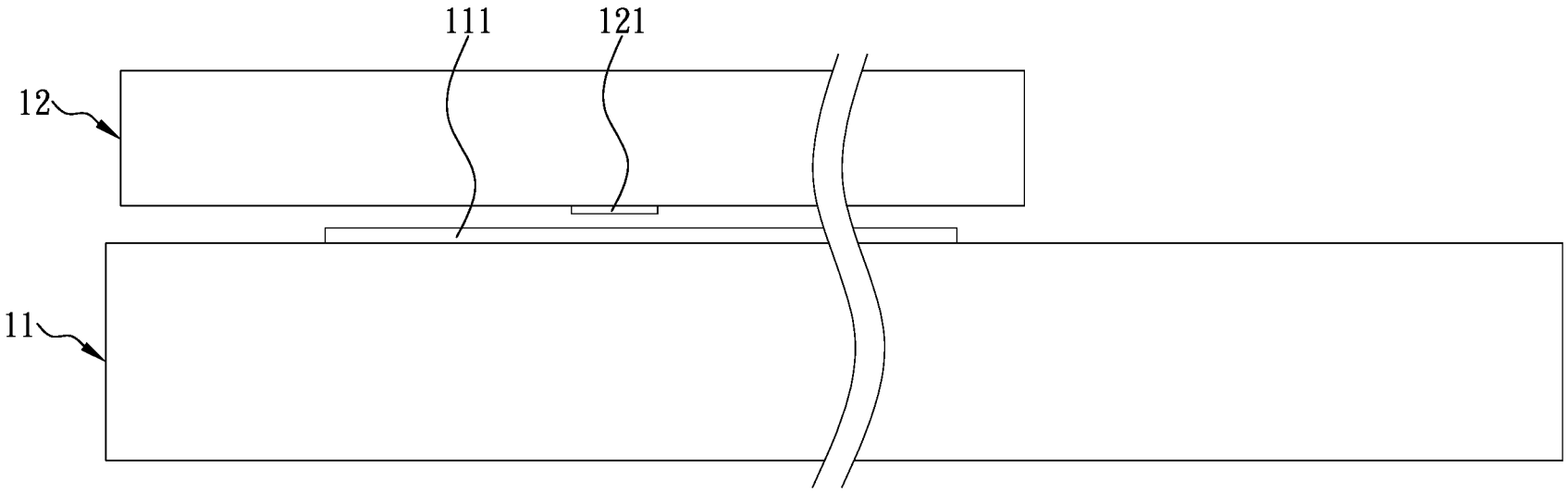
FIG. 1(Prior Art)
FIG. 1 is a schematic view of a conventional magnetic lock and an armature plate.
Figure 2:
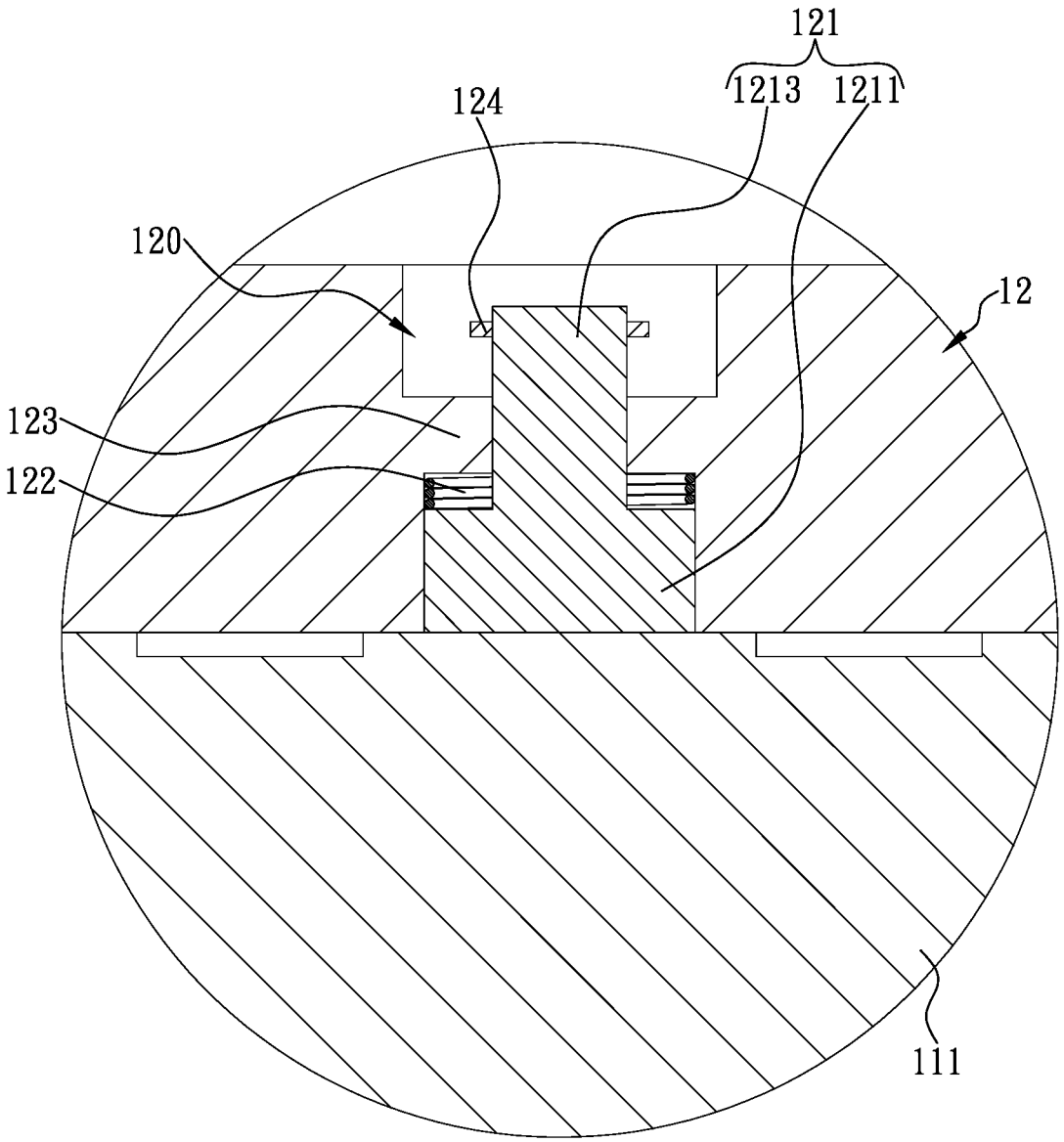
FIG. 2(Prior Art)
FIG. 2 is a sectional view of the conventional magnetic lock and the armature plate in a locked state.
Figure 3:
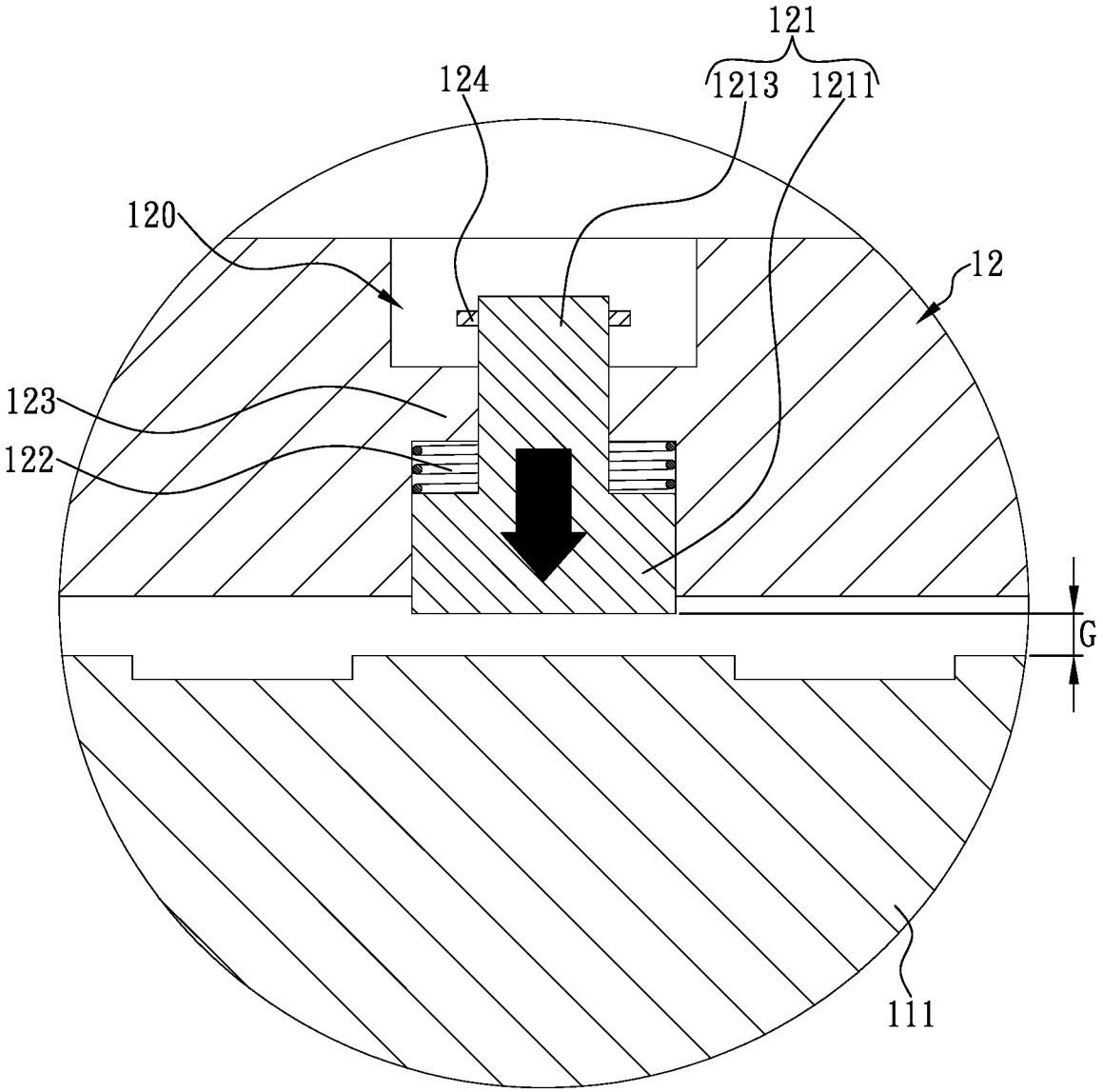
FIG. 3(Prior Art)
FIG. 3 is a sectional view of the conventional magnetic lock and the armature plate in an unlocked state.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, parts or the like, which are for distinguishing one component/part from another one only, and are not intended to, nor should be construed to impose any substantive limitations on the components, parts or the like.

Figure 4:
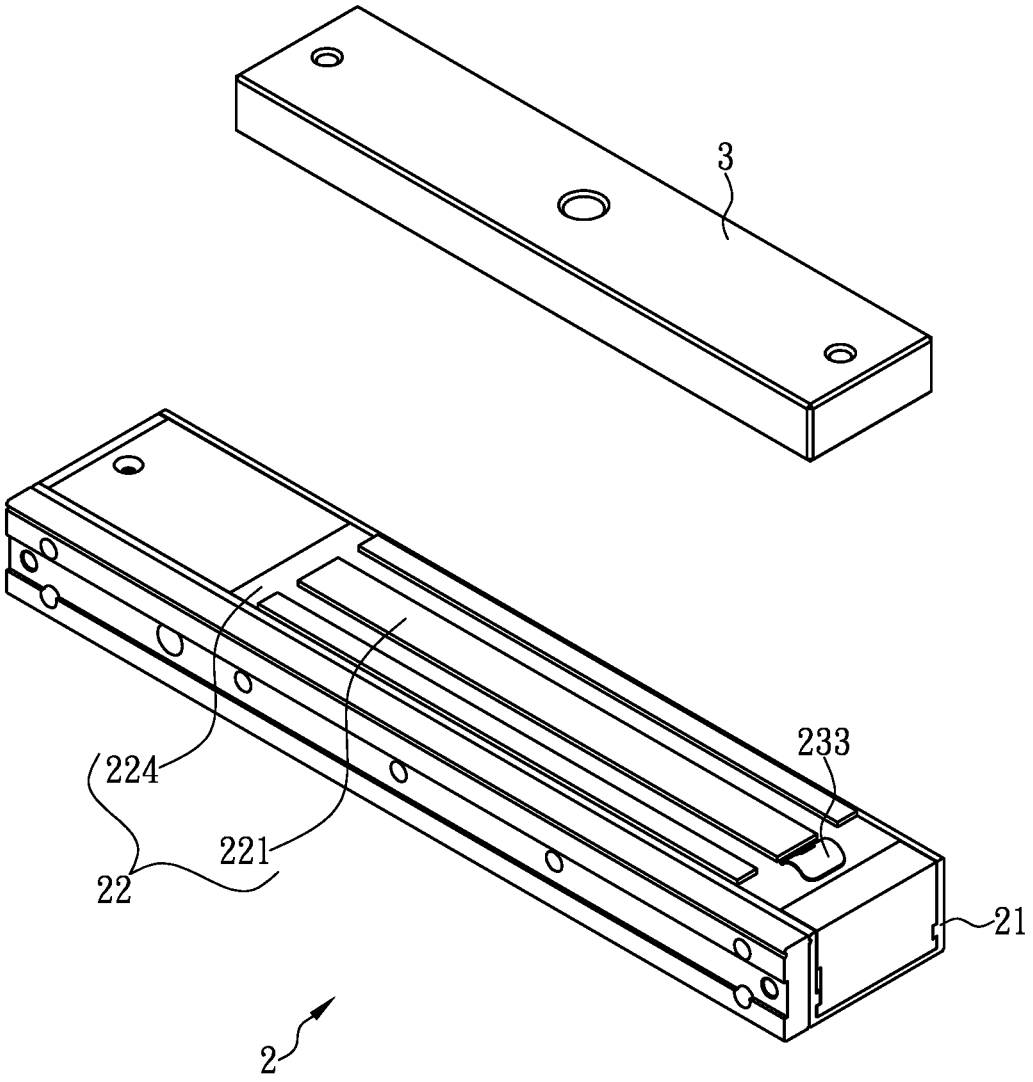
FIG. 4 is a schematic perspective view of a magnetic lock and a metal member according to the present disclosure.
Figure 5:
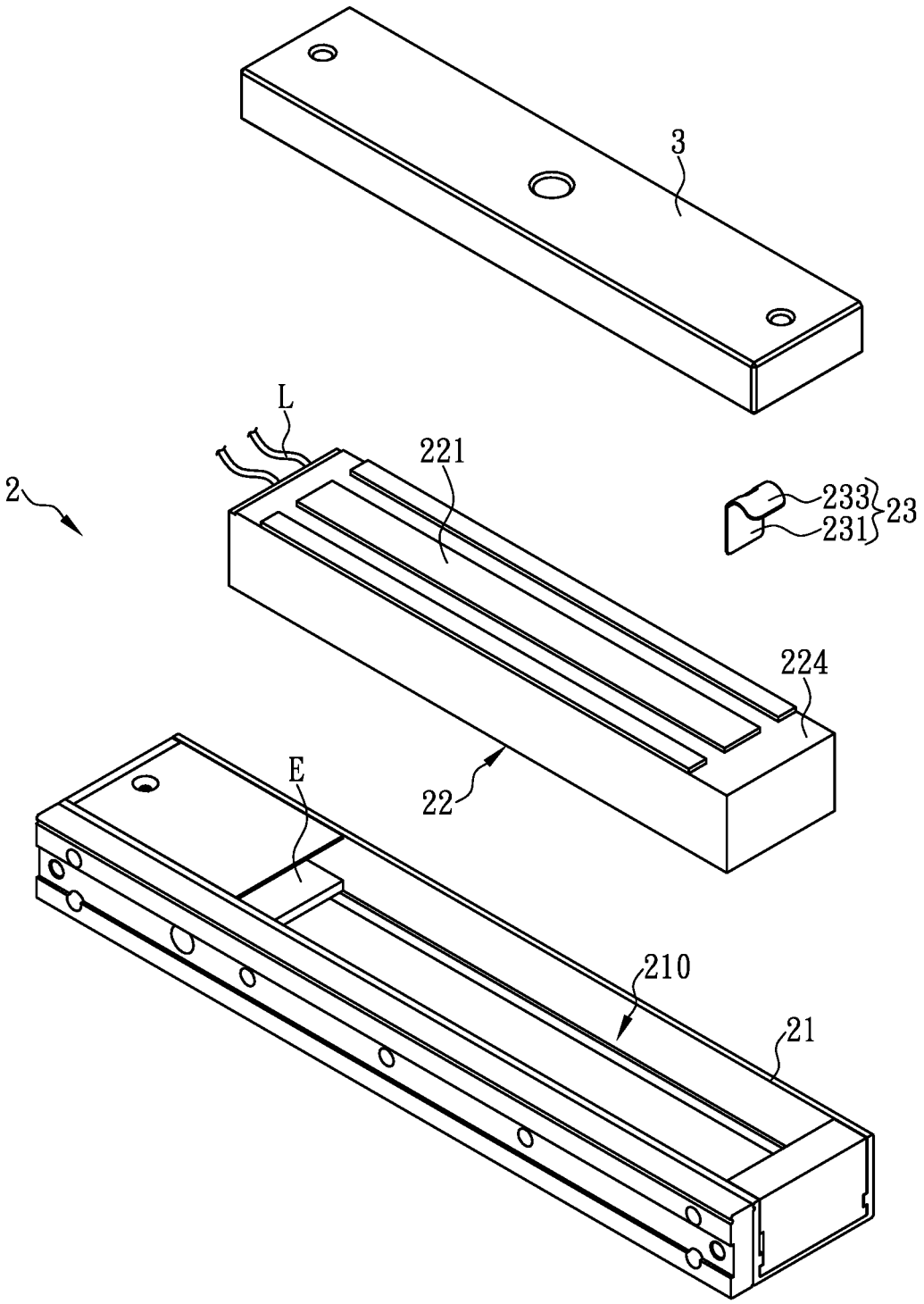
FIG. 5 is a schematic exploded view of the magnetic lock according to the present disclosure.

The present disclosure provides a magnetic lock having a resilient abutting member for eliminating remanence. Referring to FIG. 4 and FIG. 5, in certain embodiments, the magnetic lock 2 at least includes a housing 21, an electromagnetic body 22, and a resilient abutting member 23. For ease of illustration, an upper part of FIG. 4 is taken to indicate upper positions (top sides) of components herein, and a lower part of FIG. 4 is taken to indicated lower positions (bottom sides) of components herein. However, the foregoing directional indicators are used only for the purpose of describing relationships between the components, and do not limit the direction or position that the magnetic lock 2 is installed or used in practical applications.

To avoid overcomplication, FIG. 5 shows only such additional components of the magnetic lock 2 as a circuit board E and a plurality of wires L. However, persons of ordinary skill in the art, in view of the configurations of disposing the circuit board E in the housing 21, or arranging a wire L in the electromagnetic body 22 so that the electromagnetic body 22 is electrically connected with the circuit board E and receives external electricity, would be able to make their own adjustments to the configurations of the circuit board E and the wires L of the magnetic lock 2. Any magnetic lock 2 having a remanence-eliminating mechanism similar to that provided in the following description should hence fall within the scope of the present disclosure.

Figure 6:
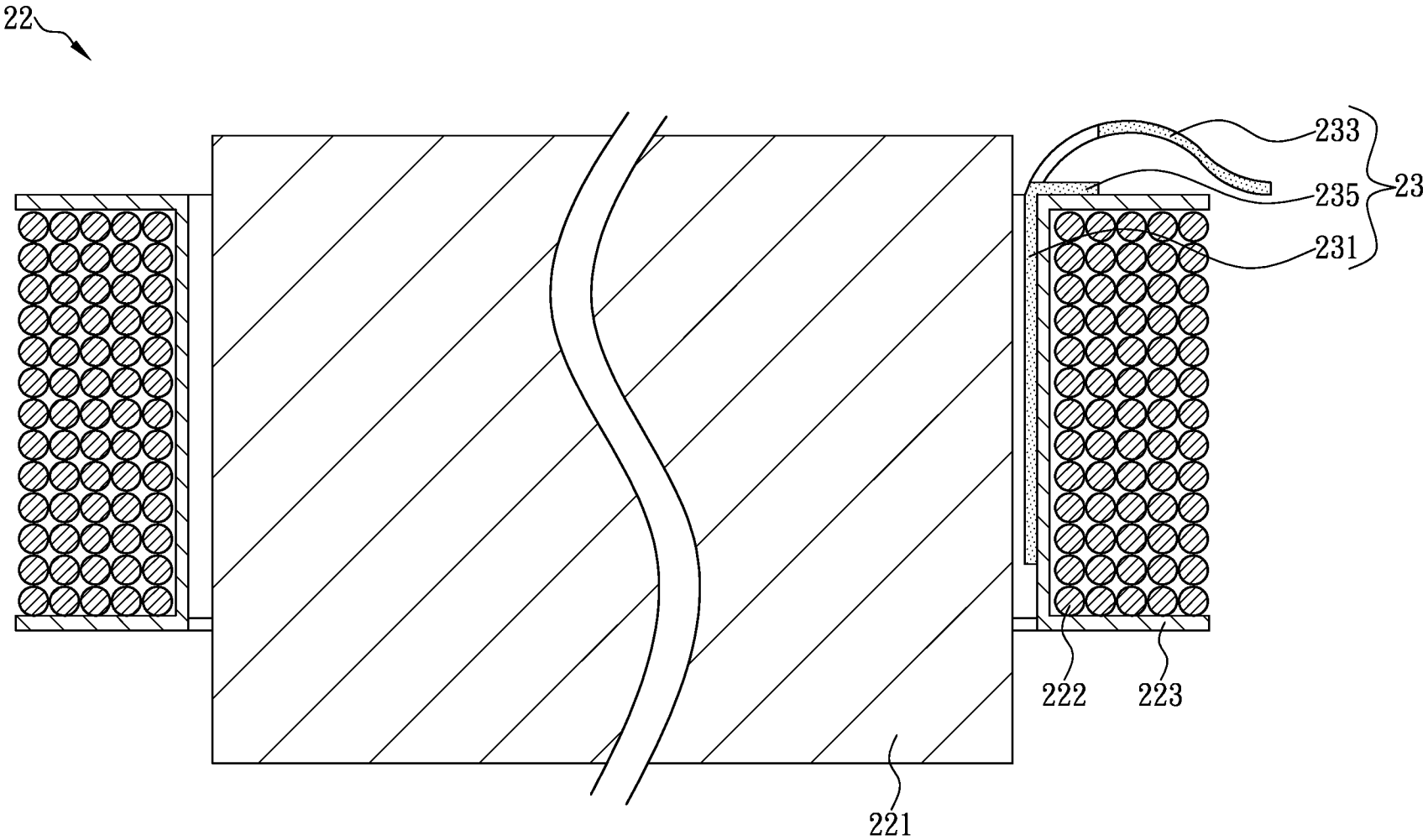
FIG. 6 is a schematic sectional view of an electromagnetic body according to the present disclosure.

Further referring to FIGS. 4 and 5, a cross section of the housing 21 can be in the shape of the letter "U", and a receiving space 210 is provided therein. The electromagnetic body 22 can be assembled within the receiving space 210 of the housing 21 with a top surface thereof being exposed from the housing 21, and the electromagnetic body 22 can receive external electricity and generate a magnetic attraction force on the top surface thereof. Referring to FIG. 6, in certain embodiments, the electromagnetic body 22 at least includes an iron core 221, a coil 222, and a coil holder 223. At least part of the iron core 221 is located in the coil holder 223 through the configuration of, e.g., a cross section of the iron core 221 being in the shape of the letter "E", the coil holder 223 being a rectangular frame body and being sleeved on the middle post of the iron core 221, and the coil 222 being wound around an outer side of the coil holder 223, so that when the coil 222 is supplied with electricity, the magnetic attraction force is generated at a top end of the iron core 221. In addition, the iron core 221 can be formed by a plurality of silicon steel sheets that are stacked upon each other to combine into a strip structure, and the iron core 221, the coil 222, and the coil holder 223 can be covered by a protective layer 224 (such as epoxy resin, rubber, etc.), with only the top end of the iron core 221 being exposed from the protective layer 224. However, in other embodiments of the present disclosure, the electromagnetic body 22 is not limited to having the structural configurations described above, and any electromagnetic body capable of being assembled to the housing 21, and capable of generating a magnetic attraction force when supplied with electricity and cease generating the magnetic attraction force when not supplied with electricity, should be considered as the electromagnetic body 22 provided in the present disclosure.

Figure 7:
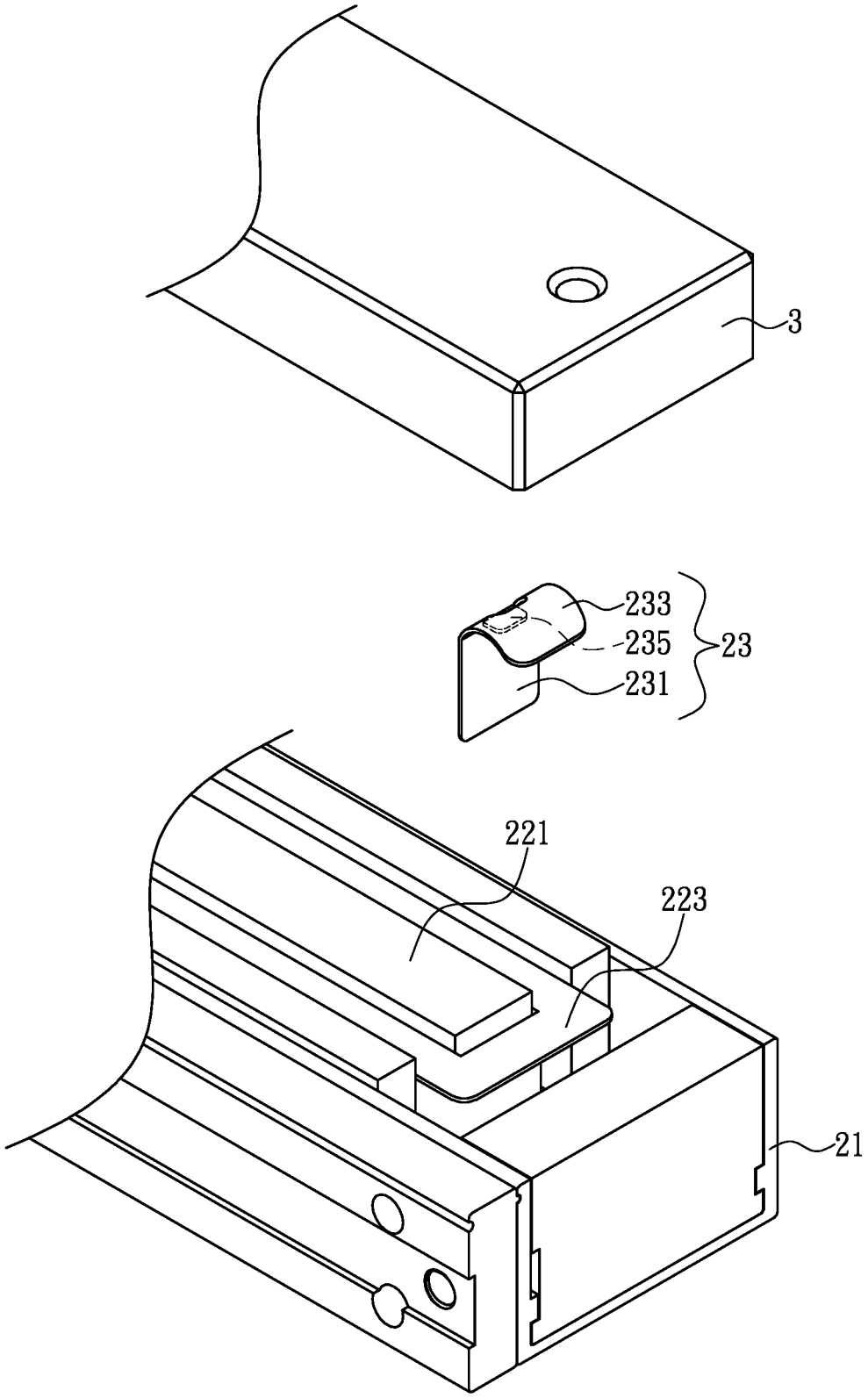
FIG. 7 is a schematic view of the electromagnetic body not including a protective layer according to the present disclosure.

In addition, further referring to FIGS. 4 and 5, the resilient abutting member 23 at least has a fixing end 231 and an abutting end 233. In certain embodiments, the resilient abutting member 23 is a flat body, with a top end section being bent to form the abutting end 233, such that the resilient abutting member 23 is substantially in the shape of an inverted letter "J". Referring to FIGS. 6 and 7, the fixing end 231 extends into the coil holder 223 to be located between the coil holder 223 and the iron core 221, so that when the protective layer 224 is provided to the electromagnetic body 22, the fixing end 231 can also be fixed in the electromagnetic body 22. Meanwhile, the abutting end 233 will be exposed from the top surface of the electromagnetic body 22, and a peak of the abutting end 233 will be at a higher elevation than the top surface of the electromagnetic body 22 (i.e., a top surface of the iron core 221). However, in other embodiments of the present disclosure, the fixing end 231 can also be fixed to the electromagnetic body 22 by soldering, fastening, adhesion, and so on, or the fixing end 231 may even be fixed in the housing 21, provided that the abutting end 233 is exposed from a top surface of the housing 21, and the peak of the abutting end 233 is at a higher elevation than the top surface of the electromagnetic body 22. Furthermore, the resilient abutting member 23 is not limited to having the shape shown in FIG. 5, and is not limited to being a single-piece component, that is, the resilient abutting member 23 may be in other shapes, or may be composed of multiple sub-components.

Figure 8:
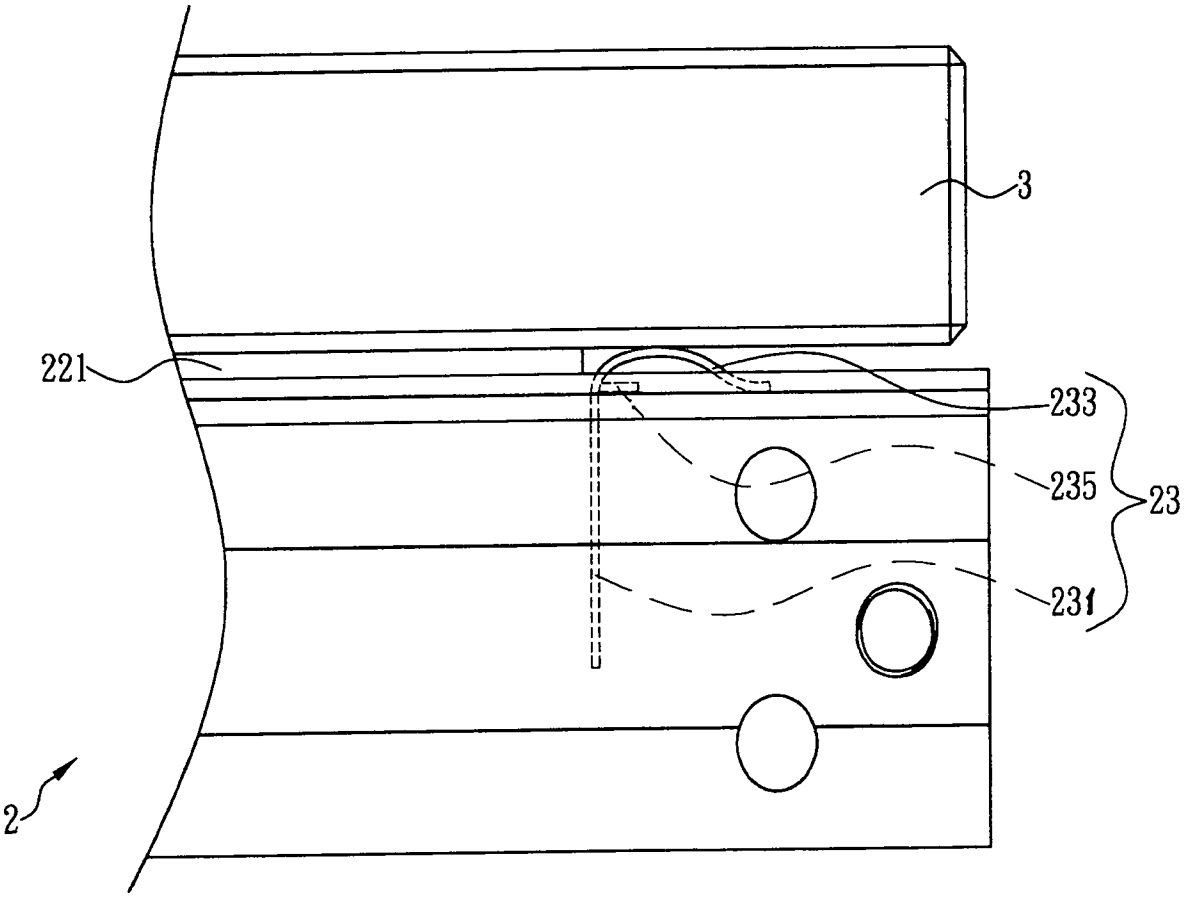
FIG. 8 is a schematic view of the magnetic lock and the metal member being in a locked state according to the present disclosure.
Figure 9:
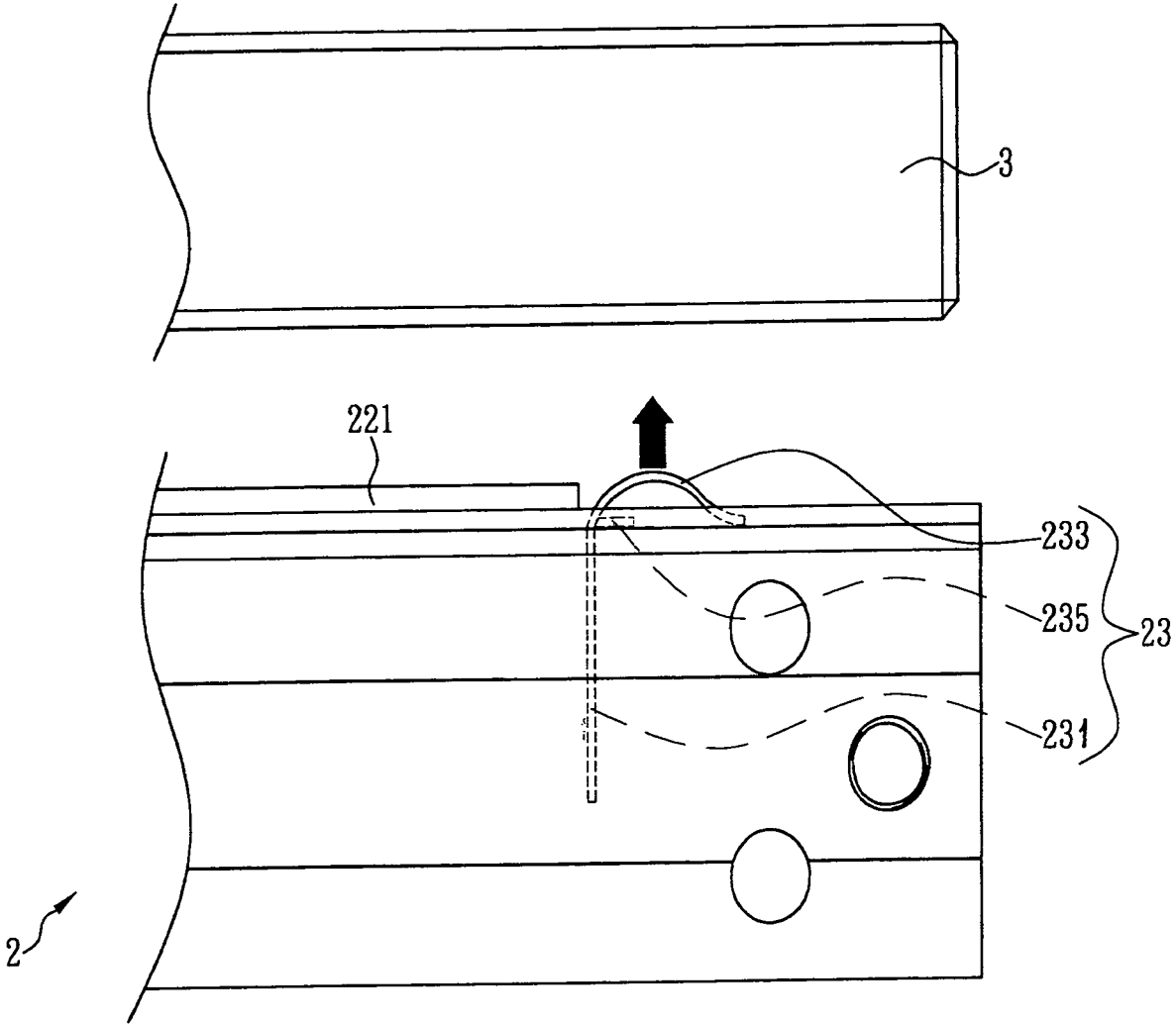
FIG. 9 is a schematic view of the magnetic lock and the metal member being in an unlocked state according to the present disclosure.

In continuance of the above, the magnetic lock 2 can be fixedly attached to an external object, such as a door frame, and a door panel can be configured with a metal member 3. Referring to FIG. 8, when the magnetic lock 2 is supplied with electricity, and the top surface of the electromagnetic body 22 (i.e., the top surface of the iron core 221) is magnetically attracted and therefore attached to the metal member 3, the door panel is in a locked state. At this time, the abutting end 233 is pressured by the metal member 3 to deform, and generates (stores) a restoring force. Referring to FIG. 9, when the supply of electricity to the magnetic lock is cut off, as the electromagnetic body 22 no longer magnetically attracts the metal member 3, the abutting end 233 is moved upward (in a direction indicated by the bold arrow in FIG. 9) by its own said restoring force so as to push the metal member 3 away from the top surface of the electromagnetic body 22 (i.e., the top surface of the iron core 221), such that a gap is formed between the metal member 3 and the magnetic lock 2 to eliminate any possible remanence. Therefore, the door panel can be in an unlocked state, so that the user can easily and quickly open the door panel. In certain embodiments, the restoring force generated by the resilient abutting member 23 applies a pushing force of 8 kgf to 12 kgf against the metal member 3 that is sufficient enough to propel the metal member 3 away.

Furthermore, referring to FIGS. 6 and 7, to prevent the entire resilient abutting member 23 from moving downward and away from its original position when pressured, a limiting portion 235 is protrudingly disposed on the resilient abutting member 23 at a position adjacent to the abutting end 233. In certain embodiments, the resilient abutting member 23 includes a flat body, and the limiting portion 235 can be formed by a stamping process at the position adjacent to the abutting end 233, but the structure and formation of the limiting portion 235 is not limited to those disclosed herein. In addition, when the resilient abutting member 23 is assembled to the electromagnetic body 22, the fixing end 231 is located between the iron core 221 and the coil holder 223, and the limiting portion 235 abuts against a top surface of the coil holder 223. Therefore, when pressured by the metal member 3, the resilient abutting member 23 can maintain its current position by blocking of the limiting portion 235. Further, in order to increase stability after assembling of the resilient abutting member 23, the limiting portion 235 can also be fixed to the coil holder 223 by soldering, fastening, adhesion, and so on.

In conclusion, further referring to FIGS. 5 to 9, by virtue of structural configuration, the magnetic lock 2 of the present disclosure provides the following advantages when compared with a conventional magnetic lock.

Since the metal member 3 is pushed by the resilient abutting member 23, the iron core 221 (the silicon steel sheets) will only come in flat contact against the metal member 3, so that the resilient abutting member 23 will not damage or lead to rusting of an electroplated layer of the iron core 221 (the silicon steel sheets), thus preserving the magnetic attraction force of the iron core 221 (the silicon steel sheets) and prolonging a service life of the magnetic lock 2.

Since the resilient abutting member 23 is disposed on the magnetic lock 2, no holes need be formed on the metal member 3, so that the structural integrity of the metal member 3 is not compromised, which can easily cause deformation, and a degree of magnetic attraction between the magnetic lock 2 and the metal member 3 can be maintained at an expected level.

Since the position where the resilient abutting member 23 abuts against the metal member 3 is outside of a region where the iron core 221 (the silicon steel sheets) corresponds in position to the metal member 3, said region can avoid damage even after long-term use, so as to provide sufficient contact area between the iron core 221 (the silicon steel sheets) and the metal member 3, and extend a product life thereof.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A remanence-eliminating magnetic lock, comprising:

a housing provided with a receiving space therein;

an electromagnetic body configured to be assembled within the receiving space of the housing with a top surface of the electromagnetic body being exposed outwardly from the housing, and operatively receiving electricity as externally supplied to generate a magnetic attraction force on the top surface of the electromagnetic body; and a resilient abutting member formed as an inverted J shape, and at least having:

a fixing end configured to be fixed within the housing or the electromagnetic body; and an abutting end formed by bending a top end portion of the resilient abutting member and configured to be exposed outwardly from the housing or the top surface of the electromagnetic body with a peak of the abutting end having a height above the top surface of the electromagnetic body, whereby when the magnetic lock is supplied with electricity to allow a metal member to be magnetically attracted to the top surface of the electromagnetic body, the abutting end will be deformably pressured by the metal member to generate a restoring force in the abutting end, and whereby when the electricity to the magnetic lock is cut off, the metal member, as urged by the restoring force of the abutting end, will be separately moved from the top surface of the electromagnetic body to thereby eliminate remanence.

2. The remanence-eliminating magnetic lock according to claim 1, wherein the electromagnetic body includes an iron core, a coil, and a coil holder, at least part of the iron core is located within the coil holder, and the coil is wound around an outer side of the coil holder so that a top end of the iron core generates the magnetic attraction force when the coil is supplied with electricity.

3. The remanence-eliminating magnetic lock according to claim 2, wherein a limiting portion is protrudingly disposed on the resilient abutting member at a position adjacent to the abutting end, and when the resilient abutting member is assembled to the electromagnetic body, the fixing end is located between the iron core and the coil holder, the limiting portion abuts against a top surface of the coil holder, and the abutting end is at a higher elevation than the top surface of the coil holder.

4. The remanence-eliminating magnetic lock according to claim 1, wherein the restoring force generated by the resilient abutting member applies a pushing force of 8 kgf to 12 kgf against the metal member.

5. The remanence-eliminating magnetic lock according to claim 2, wherein the iron core is formed by at least a plurality of silicon steel sheets that are stacked upon each other to combine into a strip structure.

* * * * *